United States Patent [19]

Andersson

[11] 4,349,284

[45] Sep. 14, 1982

[54] ASSEMBLY FOR MOVING PRINTING MEANS OF A PRINTING MACHINE

[75] Inventor: Leif H. Andersson, Åtvidaberg, Sweden

[73] Assignee: Facit Aktiebolag, Åtvidaberg, Sweden

[21] Appl. No.: 146,597

[22] Filed: May 5, 1980

[30] Foreign Application Priority Data

May 4, 1979 [SE] Sweden ..... 7903898

[51] Int. Cl.[3] ..... B41J 25/28

[52] U.S. Cl. ..... 400/320; 74/424.8 R; 400/328

[58] Field of Search ..... 400/304, 305, 320, 328, 400/322; 74/424.8 NA, 89.15, 424.8 R, 459

[56] References Cited

U.S. PATENT DOCUMENTS

| | | | |
|---|---|---|---|
| 3,479,897 | 11/1969 | Holthofer | 74/424.8 R |
| 3,670,583 | 6/1972 | Leming | 74/89.15 |
| 3,720,116 | 3/1973 | Better et al. | 74/459 |
| 3,974,709 | 8/1976 | Janson et al. | 74/89.15 |
| 4,019,616 | 4/1977 | Thorne | 400/320 |

FOREIGN PATENT DOCUMENTS

| | | | |
|---|---|---|---|
| 895634 | 3/1972 | Canada | 74/89.15 |
| 570745 | 9/1977 | U.S.S.R. | 74/424.8 R |
| 705175 | 12/1979 | U.S.S.R. | 74/424.8 R |

OTHER PUBLICATIONS

IBM Technical Disclosure Bulletin-Bernard & Meier: vol. 20, No. 2, Jul. 1977, "Carrier Support Device", pp. 567-568.

*Primary Examiner*—Edgar S. Burr
*Assistant Examiner*—C. A. Pearson
*Attorney, Agent, or Firm*—Alfred E. Miller

[57] ABSTRACT

A printing office machine in which a movable print head is driven by a device comprising a fixed, mounted lead screw and a cooperating nut member connected to an electric motor. The nut member is rotatably mounted in a carrier frame and comprises an inner tubular member which is journalled on the lead screw. An outer tubular member is journalled on the inner tubular member. An end part of the outer tubular member bears against a flange on the inner tubular member under friction. The two members are turnably interconnected by spring means, and the free ends of the members support rotatable bearings which bear on flanks of grooves cut in the lead screw. Each bearing cooperates with the groove flank which faces the respective end of the tubular member. The drive device has a very great freedom from play, and at the same time the friction prevailing between the nut member and the lead screw is minimized.

10 Claims, 7 Drawing Figures

ASSEMBLY FOR MOVING PRINTING MEANS OF A PRINTING MACHINE

The present invention relates to printing machines, such as printers, typewriters and similar types of office machines. The invention, in particular, is directed to an arrangement in a machine of this type for linear movement of a printing device relative to a recording medium. The printing device is supported by a carrier having a rotatably supported member which is in driving connection with a fixed lead screw so that rotation of the rotatable member causes displacement of the carrier along the screw. The rotatable member is driven by a driving motor supported by the carrier.

A device of the type described above is known, for example in U.S. Pat. No. 4,019,616. In the device shown and described in the patent, the rotatable member comprises two nut members, each of which threadedly engage the lead screw along a distance corresponding to several pitches. The two nut members are rigidly interconnected by splines, which also connect the nut members to a rotor, the latter being part of an electric motor provided for rotating the nut members.

In the device described hereinafter, two conflicting requirements have to be considered. On one hand the play between the nut members and the lead screw is required to be adjusted to a minimum value, since the positioning accuracy is negatively influenced by an increase of the play. On the other hand, friction losses increase as the play decreases, thereby causing an increase of wear with respect to both the nut members and the lead screw. The increased wear causes axial play which makes it necessary to readjust the nut members in order to keep the positioning accuracy of the printing device at a predetermined level. However, in case of very little play, the nut members tend to run stiffly on the lead screw thereby diminishing the maximum displacement speed, and hence the printing speed of the printing device. As a result, the size of the motor is also influenced due to the lower efficiency between the nut members and the lead screw.

It is an object of the invention to provide a means for moving a printing device of the kind described above which works without play between nut members and a lead screw, and wherein possible, wear does not deteriorate the positioning accuracy, or reduce the printing speed.

In order that the invention will be more clearly understood, it will now be disclosed in greater detail with reference to the accompanying drawings, in which.

Figure 1:
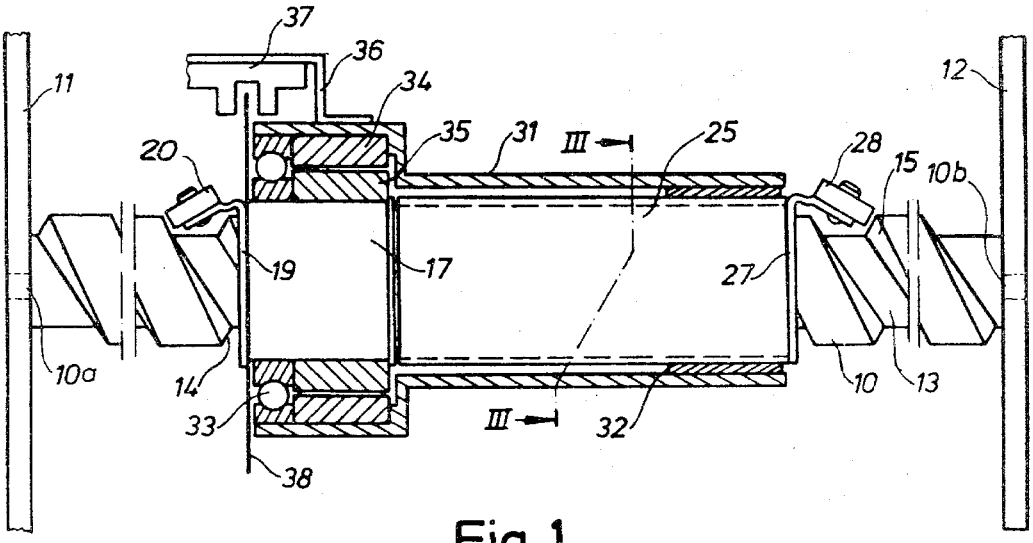
FIG. 1 is a side elevational view, partly in section, of a driving device constructed and arranged according to the invention.

As seen in FIG. 1, a lead screw 10 is provided with end parts 10*a* and 10*b*, which are securely mounted by means of screws, or other suitable means, to side walls 11 and 12 of the machine frame (not shown). The lead screw is provided with one or more helical grooves 13, the flanks 14 and 15 of which are adapted to coact with a nut device 16 in a manner which will become apparent hereinafter.

The nut device comprises an inner tubular member 17, which is journalled directly on the outer contour of the lead screw by means of slide bearings pressed into the tubular member 17. At one end, the tubular member 17 has a projection 19 acting as a support for a ball bearing 20, the inner race of which being mounted on a pin 22, and the outer race of which contacting the flank 14 of the groove in the lead screw 10.

An outer tubular member 25 is journalled directly on the inner tubular member 17. One end of the tubular member 25 is pressed into engagement with the flange 26 of the inner tubular member 17, and the other end thereof is provided with a holder 27 for a ball bearing 28 of the same type as the bearing 20. The outer race of the bearing 28 engages the flank 15 of the groove 13 in the lead screw 10. The inner and outer tubular members are interconnected by means of a coil spring 30, the ends of which engage with notches in the respective tubular member. The coil spring functions to turn one tubular member relative to the other. As a result of this turning movement the ball bearings 20 and 28 will be set along the flanks 14 and 15, respectively. A state of equilibrium will be in effect in which the outer tubular member 25 is pressed against the flange 26 on the inner tubular member 17 at the same time as the two bearings 20 and 28, without play, bear on the flanks 14 and 15, respectively.

As seen in FIG. 1, the unit formed by the inner tubular member 17 and the outer tubular member 25 is journalled in a carrier frame 31. For this purpose a slide bearing 32 is pressed into one end of the frame 31. At the other end of the frame 31 the outer race of the ball bearing 33 is pressed in, the inner race of which being pressed on the outer surface of the inner tubular member 17. The last-mentioned end of the carrier frame, which has essentially a cylindrical form, is enlarged to receive in it the ball bearing 33 and a stator 34 of an electric motor, which is provided for driving of the nut device 16. The stator is pressed into the enlarged portion of the frame 31 and surrounds a coacting rotor 35, which is pressed on the inner tubular member 17. The frame is also provided with a holder 36 supporting a light source and sensor assembly 37, which is arranged to coact with a code disc 38 for indicating the position of the carrier frame on the lead screw 10. The light source and sensor assembly comprise a light emitting diode and a phototransistor, and the code disc 38 is provided with angularly-spaced slots (not shown). Such code disc devices are commonly used in printers and typewriters adapted for printing of documents. Therefore, the code disc device will not be described in detail.

Figure 7:
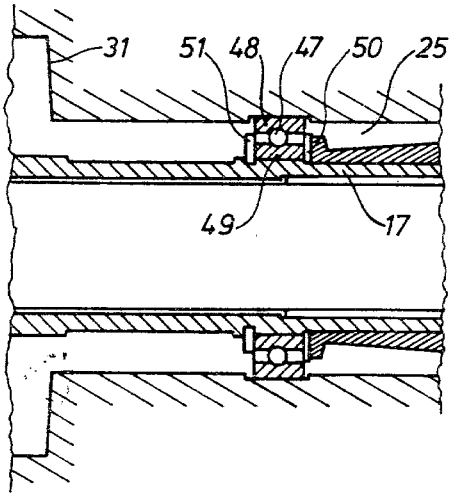
FIG. 7 is a detailed view of an alternative embodiment of the invention, with modified bearings for the nut members.

Another possible way of journalling the nut device 16 including the inner tubular member 17 and the outer tubular member 25 is shown in FIG. 7. As seen, the slide bearing 32 has been replaced by a ball bearing 47, the outer race 48 of which is pressed into the carrier frame 31, while the inner race 49 is fixed on the inner tubular member 17. In the embodiment shown therein, the outer tubular member 25 as described hereinbefore, is journalled on the inner tubular member 17. However, one end of the tubular member 17 does not engage the flange 26 but bears on the inner race 49 of the ball bearing 47 through an intermediate washer 50. A lock ring 51 is provided as a dolly.

As stated hereinbefore, the carrier drive device, according to the invention, is intended to be used in printers and typewriters for moving a printing means along a recording medium. A printing head of any kind may be provided on the carrier. Suitable printing heads for the described purpose are well known and detailed descriptions thereof need not be given.

Figure 3:
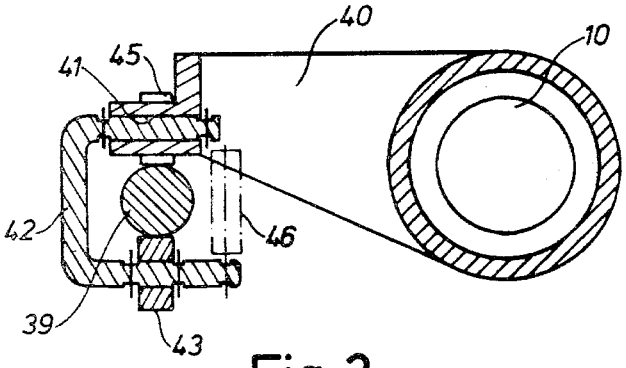
FIG. 3 is a sectional view along the line III—III of FIG. 1.

The carrier frame is equipped with guide means which cooperates with a cylindrical shaft 39 parallel to the lead screw 10 in order to prevent the carrier frame 31 from turning when the nut device 16 is rotated. The frame 31 has a part 40 (FIG. 3), which is directed backwards, as seen in FIG. 1, and which has a hole 41 for journalling a member 42. The member, which is U-shaped towards the lead screw 10, supports a roller 43 on its free end, for example a ball bearing. A cylindrical pin 44 fixed on the part 40 supports a roller 45, which may be of the same type as the roller 43. At the free end of the member is secured one end of a spring 46, while the other end thereof is secured to the part 40 in a manner shown, such that the rollers 43 and 45 are pressed against the shaft 39 from opposite sides.

Figure 4:
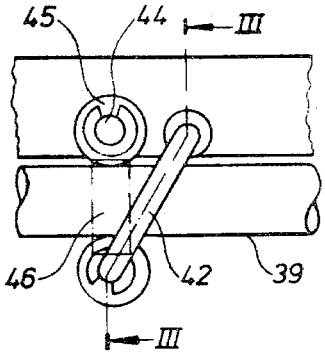
FIG. 4 is a partial side view showing parts of FIG. 3 in which the sectional line III—III of FIG. 1 is more clearly shown.
Figure 2:
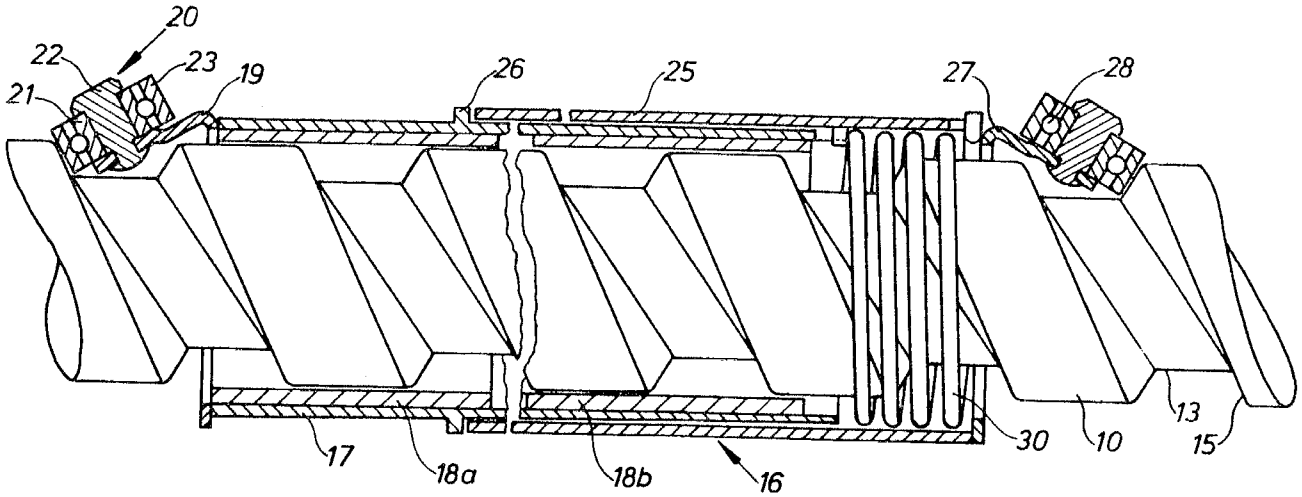
FIG. 2 is a side elevational view of the device of FIG. 1 on a larger scale, and with certain parts omitted.
Figure 5:
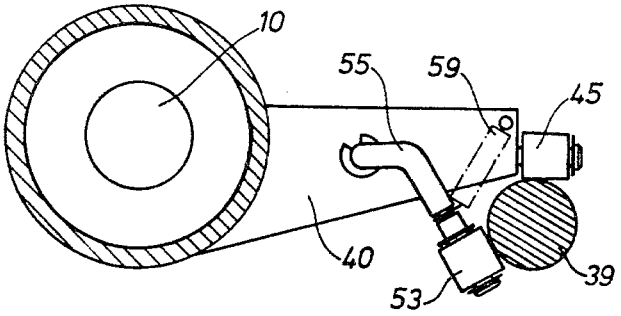
FIG. 5 is a modification of the device shown in FIG. 3.
Figure 6:
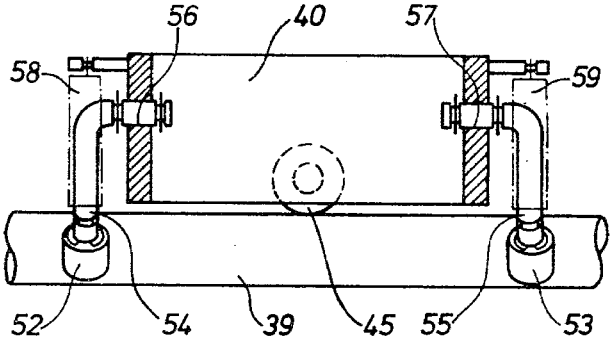
FIG. 6 is a side elevational view showing parts of FIG. 5.

Referring to FIG. 5, an alternative embodiment of the invention is shown in which the roller 43 has been replaced by two rollers 52 and 53. The rollers 52 and 53 are journalled on inverted L-shaped elements 54 and 55, which are swingably journalled in holes 56 and 57 in the part 40. Springs 58 and 59 pull the rollers 52 and 53 into contact with the shaft 39. The roller 45 of the embodiment shown in FIGS. 3 and 4 coacts with the rollers 52 and 53. Contrary to the embodiment shown in FIGS. 3 and 4, the rollers 52 and 53 are so disposed that their points of contact with the shaft 39 are displaced towards the lead screw 10. As a result, when the rollers 52 and 53, as well as roller 45 are pressed against the shaft 39, a resulting force is generated which forces the carrier towards the lead screw 10. Thereby, the play in the slide bearings 18*a* and 18*b* will be compensated for. Moreover, the biasing of the slide bearings will result in that the play will not cause the carrier to run aslant, when moving back and forth along the lead screw 10. This is of considerable importance when the printing device is working in a mode in which printing occurs when the carrier is moving. Another advantage of the present invention is that the slide bearings, due to the biasing force, becomes self-adjusting with respect to eventual wear.

The motor, which may be a brushless DC motor, is connected to an electric power source for driving of the nut device 16. The rotor 35, and thereby the inner tubular member 17, starts rotating and due to the friction between the tubular member 25 and the flange 26, the tubular member 25 will also commence to rotate. The rotating movement will continue until a predetermined position is indicated by the code disc device, and simultaneously the movement is stopped. The acceleration is determined by the fact that the friction prevailing between the flange 26 and the tubular member 25 is required to be maintained. This is achieved due to the fact that friction increases as acceleration increases. This occurs because the greater acceleration that is taken out by the carrier, the greater is the acceleration force that presses the outer tubular member 25 against the flange 26 on the inner tubular member 17. As a result, the normal component of force between the tubular member 25 and the flange 26 increases, and the increase in friction is proportional to the acceleration. Hence turning of the tubular members 17 and 25 relative to one another is prevented. Such a relative turning action is a condition for axial play to develop between the nut device and the lead screw.

The spring force that is provided by the spring 30 will be minor due to the fact that tubular member 25, and the ball bearing 28 connected to the tubular member 25, between the flange 26 and the groove flank 15, form a wedge. The pitch of the lead screw 10 is selected such that the friction angle of the wedge is slightly smaller than the angle that is required for a self-braking condition to develop. Thus, an important advantage is achieved that the nut device has freedom from play and at the same time has great ability not to cause dynamic oscillations. The explanation is that the play that can arise to the greatest extent is compensated by the friction existing between the outer tubular member 25 and the flange 26 on the inner tubular member 17. Accordingly, the nut device 16 is very little dependent on the force provided by the spring 30 in order to become free of play. This is of great importance because normally springs have a low resonance frequency. It is well known that friction is energy-consuming, which will have a damping influence on dynamic oscillations. If correctly dimensioned, the system works completely free of play, and no adjustment will be required, neither of the nut device, nor of the bearings.

From the above description it should be clear that the drive device, according to the invention, works without play between the lead screw and nut device, the result of which involves a high degree of positioning accuracy, and also a high efficiency. The lack of resilience in the system gives it good dynamic qualities. The device, in accordance with the invention, also has the advantage of a compact construction, wherein any connecting parts between motor and lead screw can be deleted. Moreover, optimal gearing is achieved in a simple way.

The embodiment described above, and shown in the drawings, is not intended to be limiting of the invention in any manner. Thus, it is intended that modifications are possible within the spirit and scope of the accompanying claims.

What is claimed is:

1. In an office machine having a printing means movable linearly along a recording medium, said printing means being supported by a carrier, a nut member rotatably mounted on said carrier being in driving connection with a fixed lead screw in a manner whereby a rotatable means causes displacement of said carrier along said screw, said rotatable means being drivingly connected to a drive motor mounted on said carrier, and means being rigidly connected to said carrier, said means coacting with a shaft for the guidance of said carrier, said shaft being located substantially parallel to said lead screw, the improvement comprising: two tubular parts constituting said nut member and being mounted in interfitting coaxial relation to each other and to said lead screw, said tubular parts having two ends in overlapping relation and two free ends, one of said parts having a radial flange, the other part having the overlapping end bearing on said flange, spring means interconnecting said tubular parts for rotation relative to each other, each of said tubular parts at its free end supporting for rotation a rotatable contact means which bears against the flank of the groove of said lead screw which faces the respective tubular part, and the rotatable contact means is so located and arranged on each of said tubular parts that the axis of rotation of said rotatable contact means is essentially parallel to the plane of the flank of the groove of said lead screw.

2. An office machine as claimed in claim 1 wherein an edge provided on the outer one of said tubular parts bears against a flange provided on the inner one of said tubular parts, said edge together with said rotatable contact means supported by said outer tubular part forming a wedge between said flange and said lead screw groove flank which engages said contact means, the pitch of said lead screw being such that the friction angle of said wedge is slightly smaller than the angle required for causing a self-braking condition for said nut member on said screw.

3. An office machine as claimed in claim 1 wherein said outer tubular part is journalled directly on said inner tubular part.

4. An office machine as claimed in claim 1 further comprising an electric motor having a rotor fixed to said inner tubular part and a stator being rigidly mounted on the frame of said carrier, the latter coaxially surrounding said tubular parts.

5. An office machine as claimed in claim 1 wherein said inner tubular part is journalled on the outer contour of said fixed lead screw, the contour having the form of a cylindrical guide surface.

6. An office machine as claimed in claim 1 wherein said outer tubular part has an edge contacting a radial flange on said inner tubular part, said outer tubular part at its free end extending beyond the corresponding end of said inner tubular part to form a space, said spring means being provided in said space.

7. An office machine as claimed in claim 6 wherein the spring means is a coil spring, the ends of which engaging notches provided in the ends of said tubular parts limiting said space.

8. An office machine as claimed in claim 1 wherein said rotatable contact means are ball bearings.

9. In an office machine having a printing means movable linearly along a recording medium, said printing means being supported by a carrier, a nut member rotatably mounted on said carrier being in driving connection with a fixed lead screw in a manner whereby a rotatable means causes displacement of said carrier along said screw, said rotatable means being drivingly connected to a drive motor mounted on said carrier, and means being rigidly connected to said carrier, said means coacting with a shaft for the guidance of said carrier, said shaft being located substantially parallel to said lead screw, the improvement comprising: two tubular parts constituting said nut member and being mounted in coaxial relation to each other and to said lead screw, said tubular parts having two ends in overlapping relation and two free ends, one of said parts having a radial flange, the other part having the overlapping end bearing on said flange, spring means interconnecting said tubular parts for rotation relative to each other, each of said tubular parts at its free end supporting for rotation a rotatable contact means which bears against the flank of the groove of said lead screw which faces the respective tubular part, said means coacting with said shaft for guidance of said carrier being two rollers which engage said shaft and are spring-biased toward each other, a pin fixed on said carrier and having one of said rollers rotatably mounted thereon, an inverted L-shaped member having the other roller mounted thereon, said member being swingably mounted on said carrier, and said two rollers being positioned and arranged to generate a force which urges said carrier in a direction towards said lead screw.

10. An office machine as claimed in claim 9 further comprising an additional roller, an additional inverted L-shaped member, said additional roller being mounted on said additional member which is swingably mounted on said carrier, said other roller and said additional roller engaging said shaft on opposite sides of the point of contact on said shaft of said one roller.

* * * * *